US007018100B2

(12) United States Patent
Clark

(10) Patent No.: US 7,018,100 B2
(45) **Date of Patent: *Mar. 28, 2006**

(54) GIFT BAG WITH NAPPED FILAMENTARY SURFACE

(75) Inventor: Elyse Clark, Newtown, CT (US)

(73) Assignee: Kool Wraps, L.L.C., Newtown, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/010,335

(22) Filed: Dec. 14, 2004

(65) Prior Publication Data

US 2005/0100250 A1 May 12, 2005

Related U.S. Application Data

(63) Continuation of application No. 10/405,468, filed on Apr. 3, 2003, now Pat. No. 6,890,102.

(51) Int. Cl.
*B65D 30/02* (2006.01)

(52) U.S. Cl. ..... 383/105; 383/6; 383/109; 229/87.19

(58) Field of Classification Search ..... 383/106, 383/6, 120, 109, 104, 25, 26; 229/87.18, 229/87.19

See application file for complete search history.

(56) References Cited

U.S. PATENT DOCUMENTS

| | | | |
|---|---|---|---|
| 686,877 | A | 11/1901 | Arkell |
| 2,127,012 | A | 8/1938 | Spangler |
| 2,153,441 | A | 4/1939 | Tillotson |
| 2,597,305 | A | 5/1952 | Doyle |
| 2,619,801 | A | 12/1952 | Evans |
| 2,896,839 | A | 7/1959 | Barnes et al. |
| 2,980,312 | A | 4/1961 | Gould |
| 3,339,822 | A | 9/1967 | Pearl |
| 3,610,307 | A | 10/1971 | Huff |
| 3,952,847 | A | 4/1976 | Via |
| 4,202,472 | A | 5/1980 | Lin |

(Continued)

FOREIGN PATENT DOCUMENTS

JP 53133180 11/1978

*Primary Examiner*—Jes F. Pascua
(74) *Attorney, Agent, or Firm*—Sterne, Kessler, Goldstein & Fox P.L.L.C.

(57) ABSTRACT

A gift bag with napped filamentary surface of the present invention includes a gift bag having generally parallel front and rear panels, each having a top edge, a bottom edge, and two lateral edges, a pair of generally parallel side panels, each having a top edge, a bottom edge, and two lateral edges, wherein the lateral edges of the front and rear panels are joined to the lateral edges of the side panels, and a bottom panel having two pairs of generally parallel lateral edges, wherein the lateral edges of the bottom panel are joined to the bottom edges of the front, rear, and side panels to form a container having an opening defined by the top edges of the front, rear, and side panels, and wherein the bag has an expanded state and a collapsed state, where an area of the bag opening is larger when the bag is in its expanded state than when the bag is in its collapsed state, and wherein the gift bag has handles attached to the panels said gift bag, and wherein the gift bag is complexly formed from a napped filamentary material, said napped filamentary material comprising at least two layers, namely, a textile layer having a napped filamentary surface, which is adhered to a smooth paper layer, forming a single sheet of napped filamentary material.

16 Claims, 5 Drawing Sheets

U.S. PATENT DOCUMENTS

| | | | | |
|---|---|---|---|---|
| 4,608,283 | A | 8/1986 | White | |
| 4,809,353 | A * | 2/1989 | Cheng | 383/6 |
| 4,836,690 | A | 6/1989 | Cheng | |
| D305,728 | S | 1/1990 | Tufariello | |
| 4,907,633 | A | 3/1990 | Eckstein | |
| 4,930,903 | A * | 6/1990 | Mahoney | 383/6 |
| D314,275 | S | 2/1991 | Frey et al. | |
| D323,977 | S | 2/1992 | Etro | |
| 5,116,655 | A | 5/1992 | Ezoe | |
| D350,475 | S | 9/1994 | Cirelli | |
| 5,441,348 | A | 8/1995 | Valentino | |
| 5,581,938 | A | 12/1996 | Weder | |
| 5,613,312 | A | 3/1997 | Crowell | |
| 5,639,523 | A | 6/1997 | Ellis | |
| 5,709,477 | A | 1/1998 | Schinasi | |
| D417,143 | S | 11/1999 | Irvine | |
| 6,092,932 | A | 7/2000 | Pekala et al. | |
| 6,146,018 | A | 11/2000 | Keller et al. | |
| 6,153,311 | A | 11/2000 | Springer | |
| 6,216,859 | B1 | 4/2001 | Manservigi | |
| D452,814 | S | 1/2002 | Furuta | |
| 6,345,912 | B1 | 2/2002 | Ho | |
| D471,089 | S | 3/2003 | Schweky | |
| 6,534,136 | B1 | 3/2003 | Weder | |
| 6,564,838 | B1 | 5/2003 | Cruickshank | |
| 6,588,309 | B1 | 7/2003 | Weder | |
| D485,166 | S | 1/2004 | Clark | |
| 6,890,102 | B1 * | 5/2005 | Clark | 383/105 |
| 2002/0069739 | A1 | 6/2002 | Weder | |
| 2002/0195368 | A1 | 12/2002 | Weder | |
| 2003/0091245 | A1 | 5/2003 | Mencacci | |

* cited by examiner

GIFT BAG WITH NAPPED FILAMENTARY SURFACE

RELATED PATENT INFORMATION

This application is a continuation of U.S. application Ser. No. 10/405,468, filed Apr. 3, 2003, now U.S. Pat. No. 6,890,102.

BACKGROUND OF THE INVENTION

The present invention relates to collapsible gift bags used to conceal (or at least partially conceal) gifts for presentation. The gift bags may be disposable or reusable. According to one aspect of the invention, the gift bags have napped filamentary surfaces. The present invention further relates to blanks for forming gift bags, and methods of manufacturing and using such gift bags.

Traditionally, gifts from one person to another are wrapped in a decorative manner to provide a visually exciting and pleasing appearance, retain an element of mystery as to the identity of the gift, and sometimes to enhance the prestige of the gift itself. Conventionally, gifts are placed within a suitable box, which is then wrapped in decorative paper that is appropriate for the event being celebrated. A trend, however, is to place gifts inside decorative bags, with the bag itself serving as both container and decorative wrapper. Thus, gifts placed in gift bags need not be first placed in another box and then wrapped before presentation.

In spite of their popularity, gift bags continue to be constructed from relatively thin, foldable paper materials that provide a decorative appearance according to colors, pictures, and designs printed on the outer surfaces. Bags constructed from such materials, however, are often flimsy, prone to puncture or tearing by pointed or heavy objects placed inside or adjacent to them, and lack an air of quality and permanence that enhances the good feelings intended to be associated with giving and receiving a gift.

A known solution to the tearing problem associated with carrying a gift bag containing a heavy gift is to reinforce the area of the bag where the handles are attached. In the case of a handle that is inserted into a hole in the bag, such reinforcement often requires lining the handle holes with a conspicuous metal or plastic grommet. Use of such grommets is disadvantageous, however, because they interrupt the decorative features of the gift bag and increase the cost of manufacture.

SUMMARY OF THE INVENTION

The present invention relates to a gift bag that has substantially parallel front and rear panels, each having a top edge, a bottom edge opposite the top edge, and two lateral edges. The gift bag may have a pair of generally parallel side panels, each having a top edge, a bottom edge opposite the top edge, and two lateral edges. According to one aspect of the invention, the lateral edges of the front and rear panels are joined to the lateral edges of the side panels. A bottom panel is provided with two pairs of generally parallel lateral edges, and the lateral edges of the bottom panel are joined to the bottom edges of the front, rear, and side panels to form a container having an opening defined by the top edges of the front, rear, and side panels. In a preferred embodiment, the bag has an expanded state and a collapsed state, where an area of the bag opening is larger when the bag is in its expanded state than when the bag is in its collapsed state.

The gift bag is completely formed from a napped filamentary material. The napped filamentary material consists of two layers, namely, a textile layer having a napped filamentary surface, and a smooth paper layer. The textile layer is adhered to the paper layer to form the sheet of napped filamentary material. A gift bag blank is formed from the napped filamentary material and is folded into a gift bag such that any seam or edge of the napped filamentary material is aligned with a natural edge or corner of the gift bag, thus rendering such seams inconspicuous. The napped filamentary material is folded in such a way as to extend over the top edges of the gift bag and onto the inner surface of the gift bag. Use of the layered napped filamentary material enhances the strength of the gift bag relative to a conventional paper gift bag and is sturdy enough to prevent tearing and puncture by heavy or sharp objects placed inside the gift bag.

The napped filamentary surface provides rounded edges and corners that are thicker and softer than those of paper gift bags, which lend the gift bag an aesthetically softer look and may prevent cuts, scrapes, and other injuries associated with the use of a conventional pager gift bag with thin paper edges and corners, especially when handled by children.

The gift bag may be provided with a pair of identical handles, where one handle is connected to front panel and the other handle is connected to the back panel of the gift bag. The handles may be of any suitable type and, as illustrated in FIG. 1, may be a relatively flexible material. If desired, the handles may be formed of a relatively stiff material and are attached in this aspect of the invention via insertion of each end of each handle through preformed holes in the front and rear panels. In a preferred embodiment of the invention, a pair of identical handles are sheathed in the same napped filamentary textile used to form the napped filamentary material of the gift bag.

The handles of the gift bag may serve as a means for attaching a gift card to the gift bag, such that the card is not easily separated from the gift bag. The attached gift card can be used to provide a convenient area on which to print a UPC symbol for inventory control, pricing, producer information, etc.

DETAILED DESCRIPTION OF PREFERRED EMBODIMENTS

Figure 1:
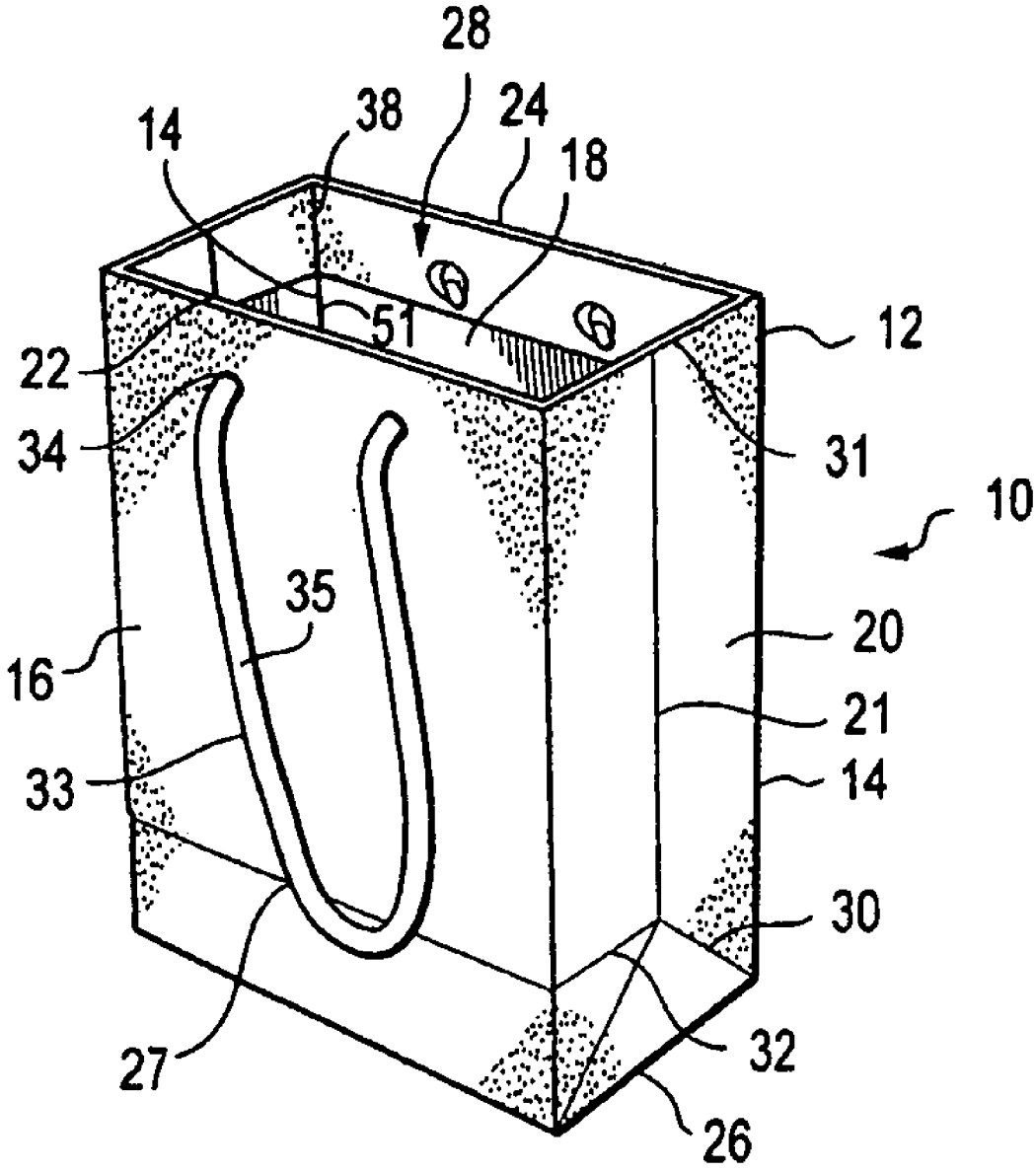
FIG. 1 is a perspective view of a gift bag with napped filamentary surface, constructed in accordance with the present invention.

Referring now to the drawings, wherein like components are labeled with like numerals throughout the several Figures, and initially to FIG. 1, one preferred embodiment of the gift bag of the present invention is shown, generally comprising a bag 10 with a napped filamentary surface 12. The bag 10 is fabricated from a napped filamentary material illustrated in FIG. 2.

Figure 2:
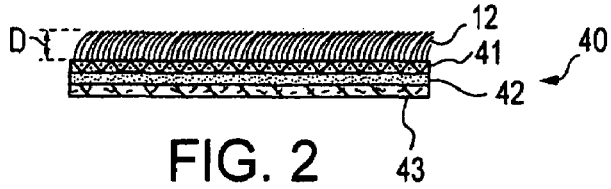
FIG. 2 is a cross sectional view, taken along line 2—2 of FIG. 3, of a napped filamentary material from which the gift bag is constructed.

As shown in cross section in FIG. 2, the napped filamentary material 40 is formed of at least three layers, namely, a textile layer 41 having a napped filamentary surface 12, a smooth paper layer 43, and an adhesive layer 42 between the textile layer 41 and the smooth paper layer 43. Note that FIG. 2 is intended to illustrate the layers of the napped filamentary material and is not drawn to scale. In a preferred embodiment, the length D of each filament forming the filamentary surface is less than five millimeters, and preferably within the range of from about one-half millimeter to about five millimeters, and even more preferably within the range of from one millimeter to three millimeters.

Figure 3:
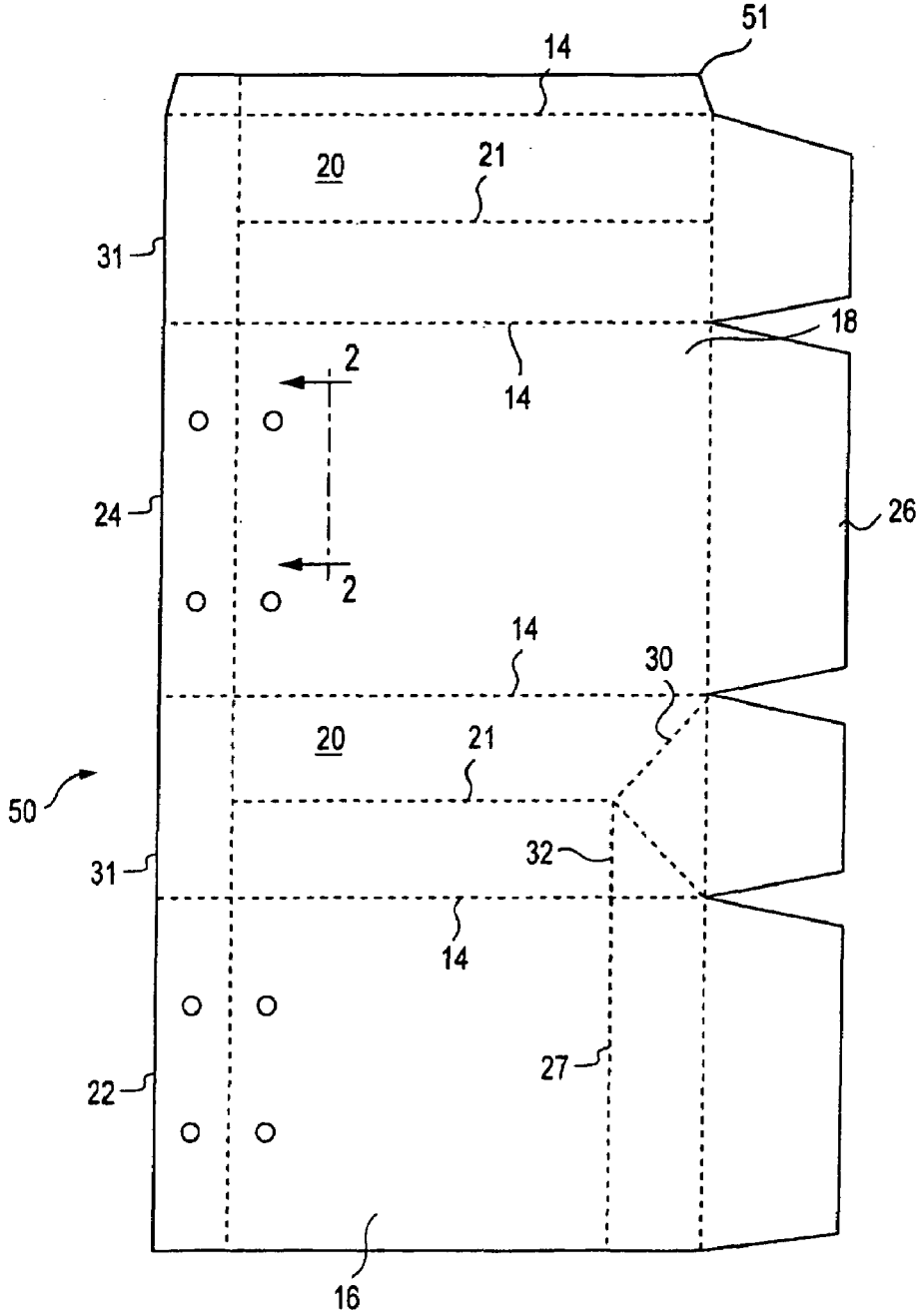
FIG. 3 is top view of a not-yet-folded blank for the gift bag of FIG. 1.

In a preferred embodiment, the napped filamentary material 40 is formed in large sheets (not shown) with all of the edges of the textile layer 41 and paper layer 43 aligned and coextensive with each other such that each sheet has one napped filamentary surface 12 and one paper surface 43. Gift bag blanks 50, as shown in FIG. 3, are then cut from the sheets of napped filamentary material.

Construction of a gift bag from the napped filamentary material described above is a multi-step process. For example, production of the textile layer 41 shown in FIG. 2 requires several steps including choosing appropriate thread, dying the thread a desired color or combination of colors, and weaving a sheet of textile material 41 from the dyed thread. The colors may be selected to produce a predetermined design on the surface 12 of the gift bag 10.

In a preferred embodiment, the textile layer 41 is manufactured from a thread composed of natural fibers (e.g. cotton), synthetic fibers (e.g. polyester or rayon), or a combination thereof. The composition of the thread may be chosen so as to impart desired qualities, such as strength and luster, to the finished textile. The thread is then dyed according to a previously determined color scheme and woven into a sheet of fabric having a napped filamentary surface 12.

Creation of the napped filamentary surface 12 requires the fabric to be woven such that the individual threads making up the sheet of fabric form loops across the fabric's surface in similar fashion to a terry cloth material known in connection with the manufacture of towels. The loops are then combed out to give the surface of the fabric a fur-like texture. Thus, the textile layer 41 of FIG. 2 the pile depth D is determined by the length of the thread loops formed during weaving. The pile depth D can range from relatively short, giving the textural appearance of suede or velvet, to relatively long, giving the textural appearance of animal fur. The range of colors of the napped filamentary surface 12, however, is not limited to the earth tones generally associated with animal fur, but rather encompasses the wide range of colors known in the textile industry. The napped filamentary surface 12 may also display a grid-like pattern resembling a woven carpet. Furthermore, in the case of a short pile fabric, a design may be embossed directly on the surface of the fabric.

The napped filamentary layer 41 is then adhered to a sheet of heavy-weight paper 43 (e.g. 120 weight). The napped filamentary layer 41 can be adhered to the paper, for example, using a high viscosity glue layer 42. The resulting multi-layer material 40 is generally flexible, but possesses a sufficient degree of stiffness such that the bag 10 shown in FIG. 1 is free standing and will remain upright when in use.

Figure 4:
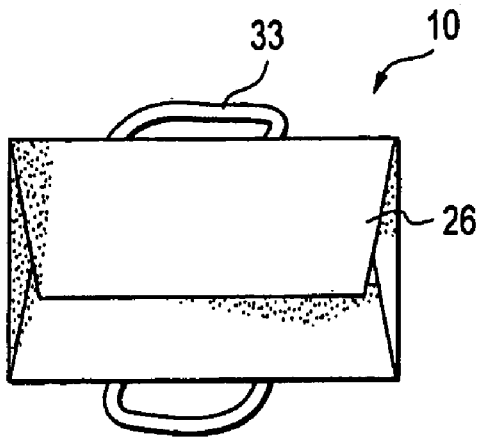
FIG. 4 is a bottom view of the gift bag of FIG. 1.

FIG. 1 shows a completed gift bag 10, having four longitudinal folds 14, dividing the bag 10 into substantially parallel front and back panels or walls 16, 18 and two substantially parallel side panels or walls 20. The parallel front and back panels 16, 18 each have an upper edge 22, 24. The bottom of the bag 10 is folded in such a way as to provide for a flat bottom 26, which is preferably rectilinear in shape as shown in FIG. 4. The gift bag 10, as illustrated in FIG. 1 in an open position, provides an opening 28 through which access is gained to the interior of the bag 10. The front panel 16 has a horizontal crease 27 or fold near the bottom of the bag.

The side panels 20 have central longitudinal creases or folds 21, a pair of diagonal folds 30 extending from the crease or fold 28, and a horizontal fold 32, extending to meet the horizontal crease 27 in the front panel 16 of the bag. The side panels 20 also have upper edges 31, which extend between the upper edges 22, 24 of the front and back panels 16, 18.

The upper edges 22, 24, 31 of the bag may be fabricated such that the edges 22, 24, 31 have a double material thickness. As a result of this double material thickness, the napped filamentary material extends over the edges 22, 24, 31 of the bag 10 and onto the inner surfaces 38 of the front panel 16, back panel, 18 and side panels 20, enhancing the decorative quality, strength, and safety of the gift bag 10. The double thickness of the edges 22, 24, 31 may extend far enough into the bag 10 to conceal the paper backing 43 for most purposes, except for those who look nearly directly into the bag 10.

FIG. 3 illustrates a gift bag blank 50 which is cut from the multi-layer material 40 of FIG. 2. The blank 50 may be used to form the gift bag 10 shown in FIG. 1. In one embodiment of the present invention, a gift bag is folded from the blank 50 such that the napped filamentary surface 12 forms the outer surface of the blank 50. Furthermore, the blank 50 is folded such that an edge 51 in the bank is aligned with a fold 14 or edge 22, 24 such that the edges 51 of the blank 50 are inconspicuous in the finished bag 10.

Figure 5:
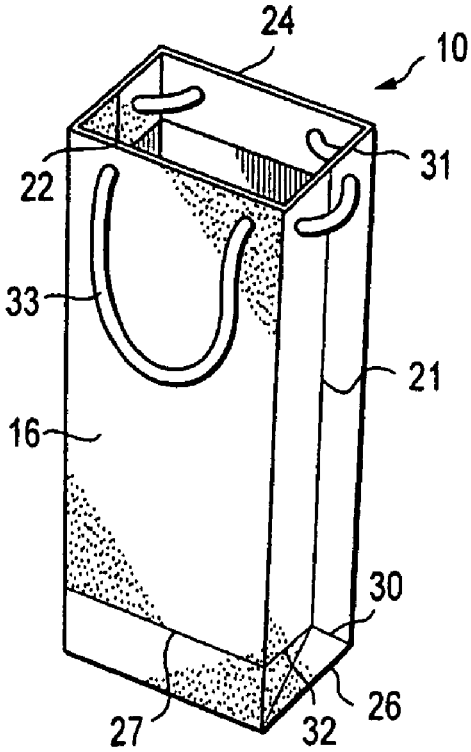
FIG. 5 is a perspective view of another gift bag constructed in accordance with the present invention, having a greater height-to-width ratio than the gift bag shown in FIG. 1.

FIG. 1 illustrates an embodiment of the gift bag 10 wherein the length and height of the gift bag are nearly identical, thus forming a square-like gift bag suitable for a variety of gifts. Yet another embodiment of the gift bag is illustrated in FIG. 5, wherein the height of the bag is nearly three times the width, thus forming a rectangular gift bag, suitable for tall, narrow gifts. It will be appreciated by those of skill in the art, however, that the dimensions of height, length, and depth can be altered to form a wide variety of bag shapes.

The gift bag 10 is preferably further provided with a pair of identical, flexible handles 33, where one handle is connected to front panel 16 and the other handle (not shown) is connected to the back panel 18. The handles 33 may be of any suitable type and, as illustrated, may be formed of a relatively flexible material, such as a ribbon, cording, or the like. Furthermore, the flexible material of the handles 33 may be sheathed in the same napped filamentary textile used to form the napped filamentary material 40 from which the gift bag is constructed. The handles 33 may be attached and secured to the bag in any suitable fashion.

In the embodiment shown in FIG. 1, the handles 33 are attached by inserting their ends through sets of identical holes 34 formed in both the front panel 16 and the rear panel 18. Each end of the handles 33 is then knotted, thus preventing it from slipping back through the handle hole 34. Note that the handle holes 34 need not be lined, such as with metal grommets, to prevent the handles 33 from tearing through the holes 34 when the bag contains a relatively heavy object.

Although the handles 33 are illustrated as lying on the outside surface of the front panel 16, the handles 33 may alternatively be relatively rigid and extend generally upwardly from the upper edge 22, 24 of the front and back panels 16, 18.

Figure 6:
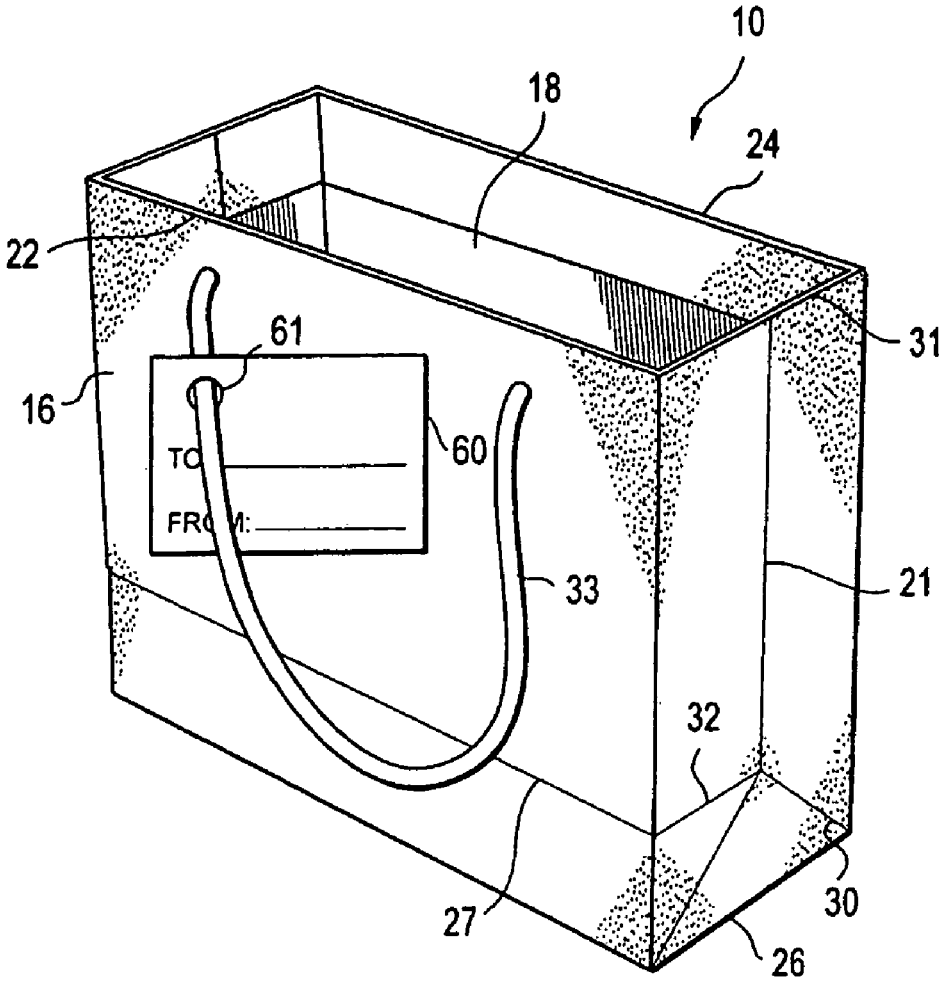
FIG. 6 is a perspective view of another gift bag constructed in accordance the present invention, showing an attached gift card.

In another exemplary embodiment of the present invention shown in FIG. 6, the handles 33 of the gift bag described above further provide a means of attaching a gift card 60 to the gift bag 10. In this embodiment, a gift card 60, constructed from a paper material, is provided along with the gift bag 10. The card 60 may be manufactured in such a way that any design or colors preprinted on its surface compliment the design and colors of the gift bag it is intended to accompany. At least one hole 61, large enough to accommodate the diameter of a desired gift bag handle, is punched through the card 60. During attachment of the handles to the gift bag 10, a gift card 60 is attached to the gift bag 10 by threading at least one end of a handle 33 through the hole 61 in the card 60. The handle 33 is then attached to the bag 10 as described above.

Attaching a gift card to the gift bag handle provides several advantages when making gift bags from the napped filamentary material described above. For example, it is often desirable to present a gift card along with the gift contained in the gift bag. Such gift cards typically serve the purposes of labeling the gift with the name of its intended recipient and providing a means of expressing a sentiment appropriate to a given occasion. Gift cards, however, can easily become separated from their associated gift. The above method of attaching a gift card to a gift bag provides a convenient means of ensuring a gift and its card remain together.

Yet another advantage of attaching a gift card to the handle of a gift bag made from the napped filamentary material is the ability to print a Universal Product Code (UPC symbol) for the gift bag and card on the gift card. The UPC symbol may be a bar code used to identify the product and its manufacturer. UPC symbols appear on many retail products in the United States and are used to allow computer scanning systems to identify a product for both checkout and inventory purposes. Gift bags made from the napped filamentary material described above are not suited to having a UPC symbol printed or otherwise attached directly on the surface of the bag, as is typical for gift bags constructed entirely from paper. While UPC symbols could be printed on the inside of the gift bag, this location is disadvantageous due to the increased difficulty in locating and scanning the symbol. Attaching a gift card to the gift bag provides a convenient and user-friendly location for placement of the UPC symbol, other written indicia and information, and/or graphics, including trademarks and pricing.

Gift bags constructed from the above-described napped filamentary material also have softer edges and rounder corners than conventional paper gift bags. These unique features give the gift bags of the present invention an aesthetically softer look. The appearance of the napped filamentary material also lends gift bags of the present invention an air of quality and permanence that enhances both the prestige of the gift therein and the good feelings associated with giving and receiving a gift.

Another advantage of the soft edges and round corners of the present inventions is the prevention of potential cuts, scrapes, eye injuries and the like associated with conventional paper gift bags having thin paper edges and stiff pointed corners. The fear of such injuries may be especially present in connection with birthday parties and other occasions where small children may be present.

Figure 7:
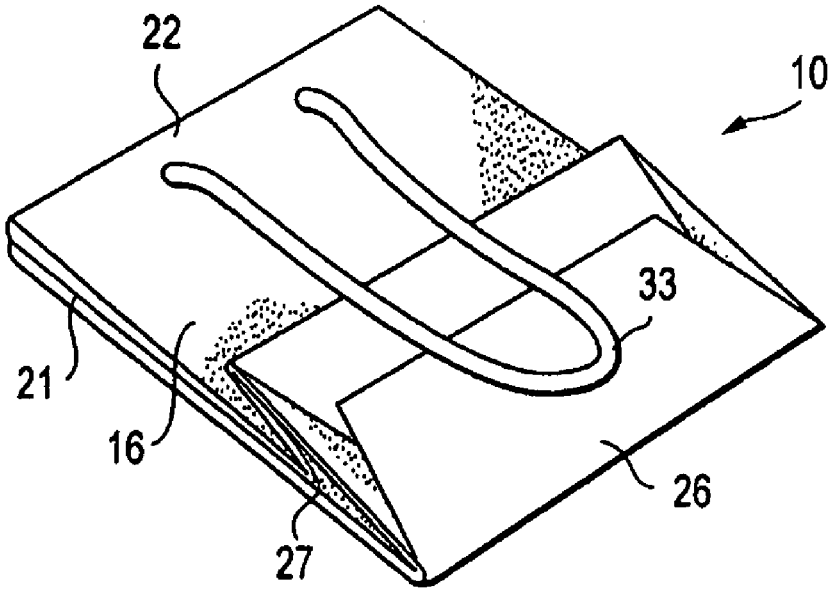
FIG. 7 is a perspective view of a gift bag of the present invention shown in a folded state.
Figure 8:
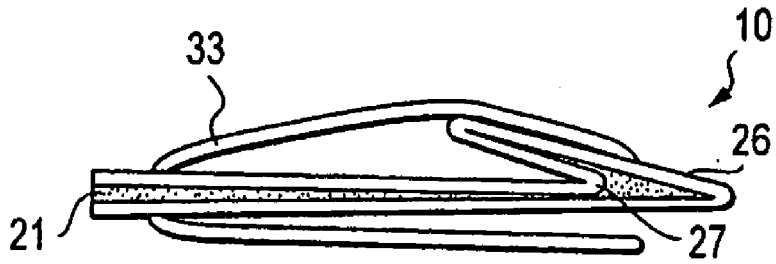
FIG. 8 is a side view of the folded gift bag of FIG. 7.

According to a preferred embodiment of the invention, the gift bag with napped filamentary surface is designed with creases 21, 27, 30, 32, as shown in FIG. 1, to enable the bag to be stored flat when not in use. FIGS. 7 and 8 illustrate a folded gift bag. According to one aspect of the invention, the length D of the filaments in the filamentary surface 12 is not so long as to preclude folding the bag tightly in stacks with other such bags for shipping, storage and display.

Although the present invention has been described in relation to particular embodiments, many other variations and modifications and other uses will become apparent to those of skill in the art. The present invention should be limited only by the appended claims.

What is claimed is:

1. A gift bag comprising:

substantially parallel front and rear panels, each having a top edge, a bottom edge opposite the top edge, and two lateral edges; and a pair of substantially parallel side panels, each having a top edge, a bottom edge opposite the top edge, two lateral edges;

wherein the lateral edges of the front and rear panels are joined to the lateral edges of the side panels, and a bottom panel having two pairs of substantially parallel lateral edges, wherein the lateral edges of the bottom panel are joined to the bottom edges of the front, rear, and side panels to form a container having an interior portion defined by the front, rear, and side panels and the bottom panel, said container further having an opening width defined as the distance between the top edges of the front and rear panels; and wherein the exterior surface of said gift bag is formed from a napped filamentary material, and the top edges of the gift bag have a double thickness of said napped filamentary material such that a portion of the inner surface of the gift bag is formed from the napped filamentary surface.

2. The gift bag of claim 1, wherein said napped filamentary material comprises at least a paper layer and a napped filamentary textile layer adhered to said paper layer to form a single sheet of napped filamentary material.

3. The gift bag of claim 2, wherein said paper layer and said napped filamentary textile layer are coextensive with each other.

4. The gift bag of claim 2, wherein said gift bag is formed such that an cut edge of said single sheet of napped filamentary material is aligned with a folded edge of said gift bag.

5. The gift bag of claim 1, further comprising a handle.

6. The gift bag of claim 1, further comprising a pair of handles, wherein one handle is connected to the front panel and the other handle is connected to the rear panel.

7. The gift bag of claim 6, wherein said handles are attached to the front and rear panels by passing through a pair of holes in each of said panels.

8. The gift bag of claim 6, wherein said handles are covered in said napped filamentary material.

9. The gift bag of claim 6, wherein a card with printed information is attached to at least one of said handles.

10. The gift bag of claim 1, wherein the pile of the napped filamentary surface is short to resemble suede.

11. The gift bag of claim 1, wherein the pile of the napped filamentary surface is long to resemble the fur of an animal.

12. A gift bag comprising:

substantially parallel front and rear panels, each having a top edge, a bottom edge opposite the top edge, and two lateral edges; and a pair of substantially parallel side panels, each having a top edge, a bottom edge opposite the top edge, two lateral edges;

a pair of handles, wherein one handle is connected to the front panel and the other handle is connected to the rear panel;

wherein the lateral edges of the front and rear panels are joined to the lateral edges of the side panels, and a bottom panel having two pairs of substantially parallel lateral edges, wherein the lateral edges of the bottom panel are joined to the bottom edges of the front, rear, and side panels to form a container having an interior portion defined by the front, rear, and side panels and the bottom panel, said container further having an opening width defined as the distance between the top edges of the front and rear panels; and wherein the exterior surface of said gift bag and the handles are formed from a napped filamentary material.

13. The gift bag of claim 12, wherein the top edges of the gift bag have a double thickness of said napped filamentary material such that a portion of the inner surface of the gift bag is formed from the napped filamentary surface.

14. The gift bag of claim 12, wherein said napped filamentary material comprises at least a paper layer and a napped filamentary textile layer adhered to said paper layer to form a single sheet of napped filamentary material.

15. The gift bag of claim 12, wherein the pile of the napped filamentary surface is short to resemble suede.

16. The gift bag of claim 12, wherein the pile of the napped filamentary surface is long to resemble the fur of an animal.

* * * * *